US007340813B2

(12) United States Patent
Hampton et al.

(10) Patent No.: US 7,340,813 B2
(45) Date of Patent: Mar. 11, 2008

(54) CHAIR UPHOLSTERED WITH SPORTS JERSEY

(75) Inventors: Kerry J. Hampton, Winnipeg (CA); Kevin S. Hampton, Winnipeg (CA)

(73) Assignee: Jersey Chair Inc., Winnipeg (CA)

( * ) Notice: Subject to any disclaimer, the term of this patent is extended or adjusted under 35 U.S.C. 154(b) by 53 days.

(21) Appl. No.: 11/257,029

(22) Filed: Oct. 25, 2005

(65) Prior Publication Data

US 2006/0097552 A1 May 11, 2006

(30) Foreign Application Priority Data

Nov. 10, 2004 (CA) ..... 2487226

(51) Int. Cl.
*B68G 7/00* (2006.01)
*A63G 9/10* (2006.01)
*A47C 31/00* (2006.01)

(52) U.S. Cl. ..... 29/91; 297/181; 297/228.1; 297/227

(58) Field of Classification Search ..... 297/219.1, 297/228.1, 229, 225, 227, 228, 181; 29/91, 29/91.1, 448
See application file for complete search history.

(56) References Cited

U.S. PATENT DOCUMENTS 4,694,511 A * 9/1987 Estes et al. ..... 2/69
D310,314 S * 9/1990 Caron ..... D6/611
D365,958 S * 1/1996 Bolewski ..... D6/611
5,509,720 A * 4/1996 Croom ..... 297/440.14
5,700,053 A * 12/1997 Downing ..... 297/227
5,707,107 A * 1/1998 Melone ..... 297/228.1
D396,983 S * 8/1998 Taylor ..... D6/611
D458,073 S * 6/2002 Spitzer ..... D6/611
6,540,302 B1 * 4/2003 Crocker et al. ..... 297/452.31
6,948,771 B1 * 9/2005 Salandy ..... 297/228.11
7,168,760 B2 * 1/2007 Kenny ..... 297/229

* cited by examiner

*Primary Examiner*—Sarah B. McPartlin
(74) *Attorney, Agent, or Firm*—Ryan W. Dupuis; Adrian D. Battison; Michael R. Williams

(57) ABSTRACT

An article of furniture, for example a chair, is upholstered with a sports jersey for displaying the jersey thereon. The front side and logo of the jersey are displayed on the back supporting surface of the chair while the rear side and player number of the jersey are displayed on the seating surface of the chair. The chair arms are upholstered with arms of the sports jersey. By providing a chair upholstered with a sports jersey conventional, authentic and readily available sports equipment can be reused in a practical way and displayed in an aesthetically pleasing manner.

11 Claims, 4 Drawing Sheets

CHAIR UPHOLSTERED WITH SPORTS JERSEY

This application claims foreign priority benefits from Canadian Patent Application 2,487,226 filed Nov. 10, 2004.

FIELD OF THE INVENTION

The present invention relates to a chair for supporting a person thereon in which the chair is upholstered with a sports jersey for displaying the sports jersey on the chair.

BACKGROUND

Various types of sports memorabilia are well known. Typical items are decorated with team logos and team colours. Typically such memorabilia items cannot be made of authentic components of actual sports equipment.

SUMMARY OF THE INVENTION

According to one aspect of the invention there is provided a chair in combination with a sports jersey having a front side and a back side, the chair comprising:

a seat support surface for supporting a person seated thereon;

legs for supporting the seat support surface spaced above the ground; and a back support surface extending upwardly from the seat support surface;

one of the support surfaces being upholstered with either the front side or the back side of the sports jersey.

According to a second aspect of the present invention there is provided a method of displaying a sports jersey on a chair, the sports jersey having a front side and a back side, said method comprising:

providing a chair having a seat support surface for supporting a person seated thereon, legs for supporting the seat support surface spaced above the ground and a back support surface extending upwardly from the seat support surface; and upholstering one of the support surfaces of the chair with either the front side or the back side of the sports jersey.

By providing a chair upholstered with a sports jersey, conventional and authentic, readily available sports equipment can be reused in a practical way. The design of the chair allows a sports jersey to be displayed in an aesthetically pleasing manner while being functional in a new use.

Preferably, the back support surface is upholstered with the front side of the sports jersey and the seat support surface is upholstered with the back side of the sports jersey.

When the chair includes chair arms, the chair arms are preferably upholstered with arms of the sports jersey.

A top side of the back support surface may be upholstered with a name bar of the sports jersey.

The legs of the chair are preferably upholstered with pliable material matching the sports jersey in color.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
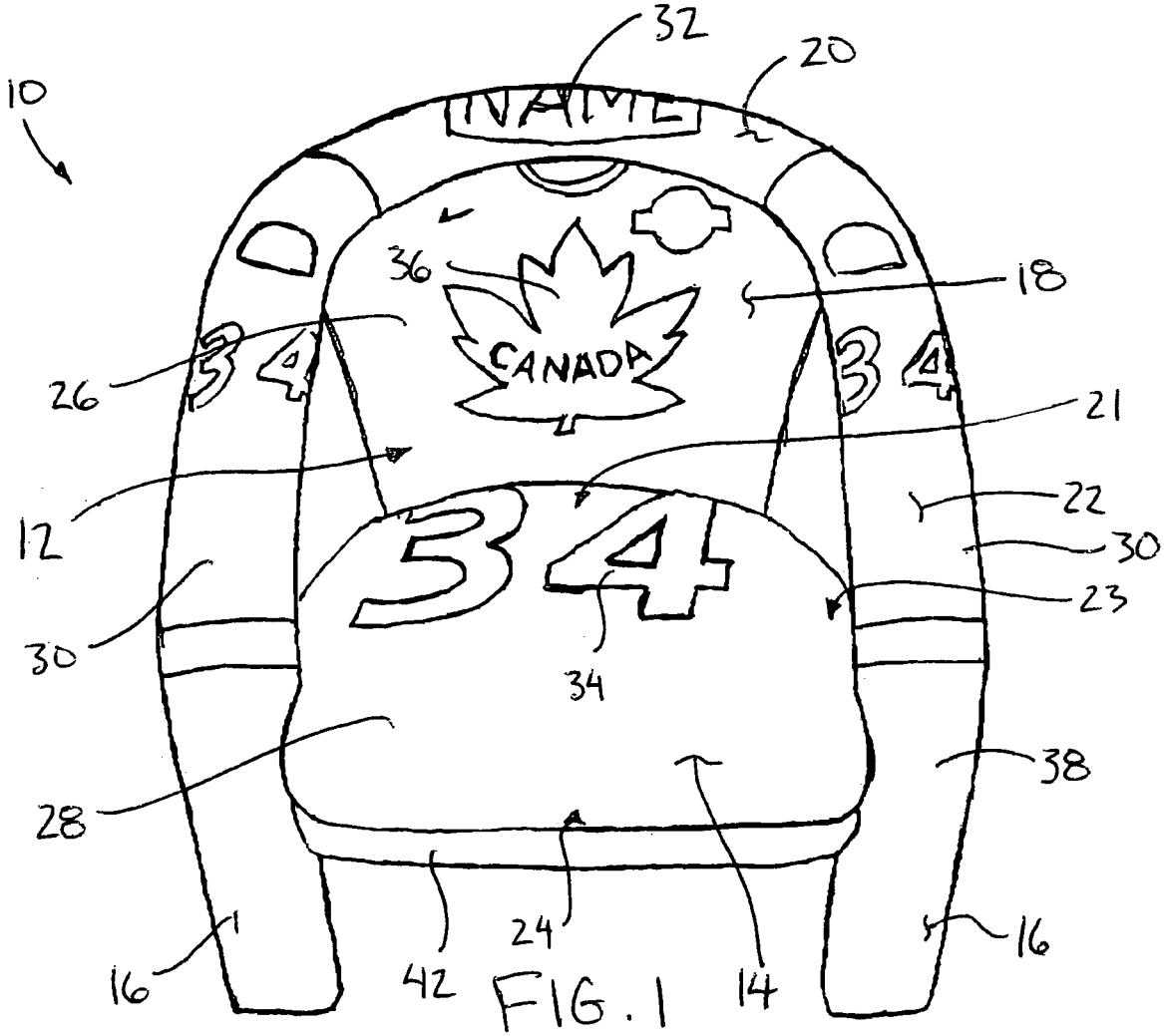
FIG. 1 is a perspective view of the chair.
Figure 2:
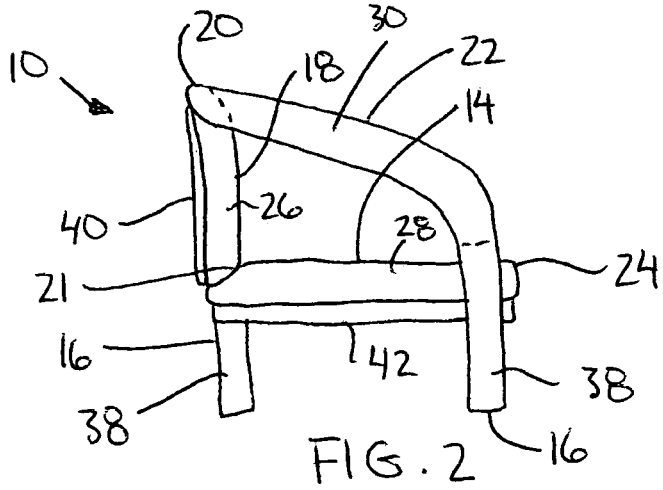
FIG. 2 is a side elevational view of the chair.
Figure 3:
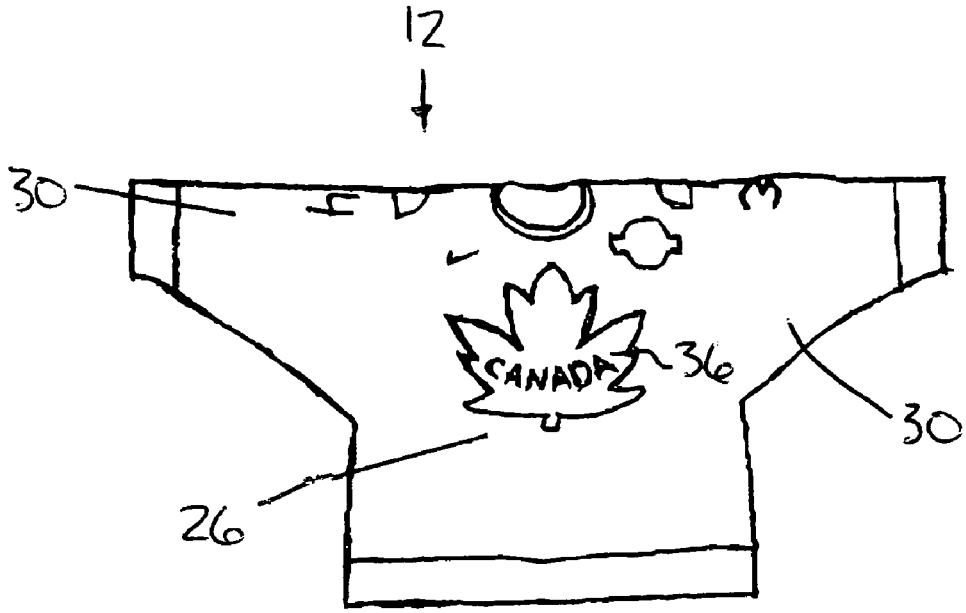
FIG. 3 and FIG. 4 are elevational views of the front side and back side of the sports jersey.
Figure 4:
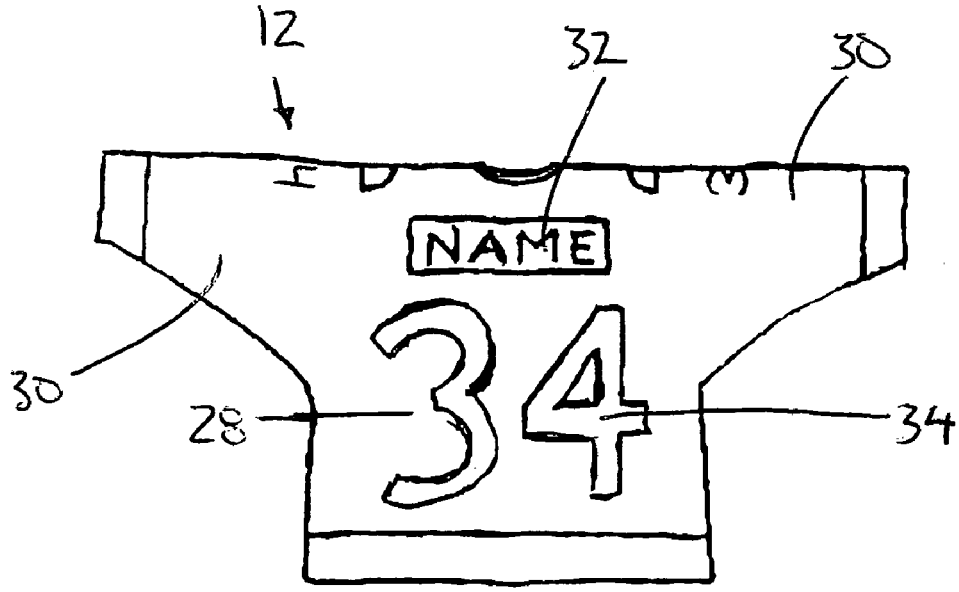

Referring to the accompanying figures there is illustrated a chair generally indicated by reference numeral 10. The chair 10 is intended to be just one example of an article which may be upholstered with a sports jersey 12 for displaying the jersey thereon.

The chair 10 includes a generally horizontally extending seat supporting surface 14 upon which a seated person may be supported. A set of legs 16 are supported in an upright orientation at respective corners of the generally rectangular seat supporting surface 14. The legs 16 support the seating support surface 14 spanning across the top end thereof spaced above the ground.

The chair 10 further includes a back supporting surface 18 extending generally vertically upward in an upright orientation from a rear edge of the seat supporting surface 14. The back supporting surface extends upward to a top side 20 facing generally upward.

A pair of chair arms 22 are provided spaced above opposing sides of the seat supporting surface 14 for supporting the arms of a person seated in the chair thereon. Each arm spans between the back supporting surface 18 spaced above the seat to a front edge 24 of the seat at the sides 23 thereof. An open space is thus defined between each arm 22 and the seat supporting surface 14 therebelow.

The jersey 12 includes a front side 26 of fabric material and a back side 28 of fabric material, which together form a torso portion of the jersey having a neck opening and arm openings so that the front and back sides are joined at seams along sides of the torso portion and at the shoulders thereof. Jersey arms 30 comprise tubular sleeves of fabric material connected to the front and back sides at the arm holes of the torso portion of the jersey. A name bar 32 spans across the shoulders of the jersey at the back side 28 thereof. As with typical sports jerseys, a player number 34 is provided on the back side and a team logo 36 is provided on the front side 26.

Figure 5:
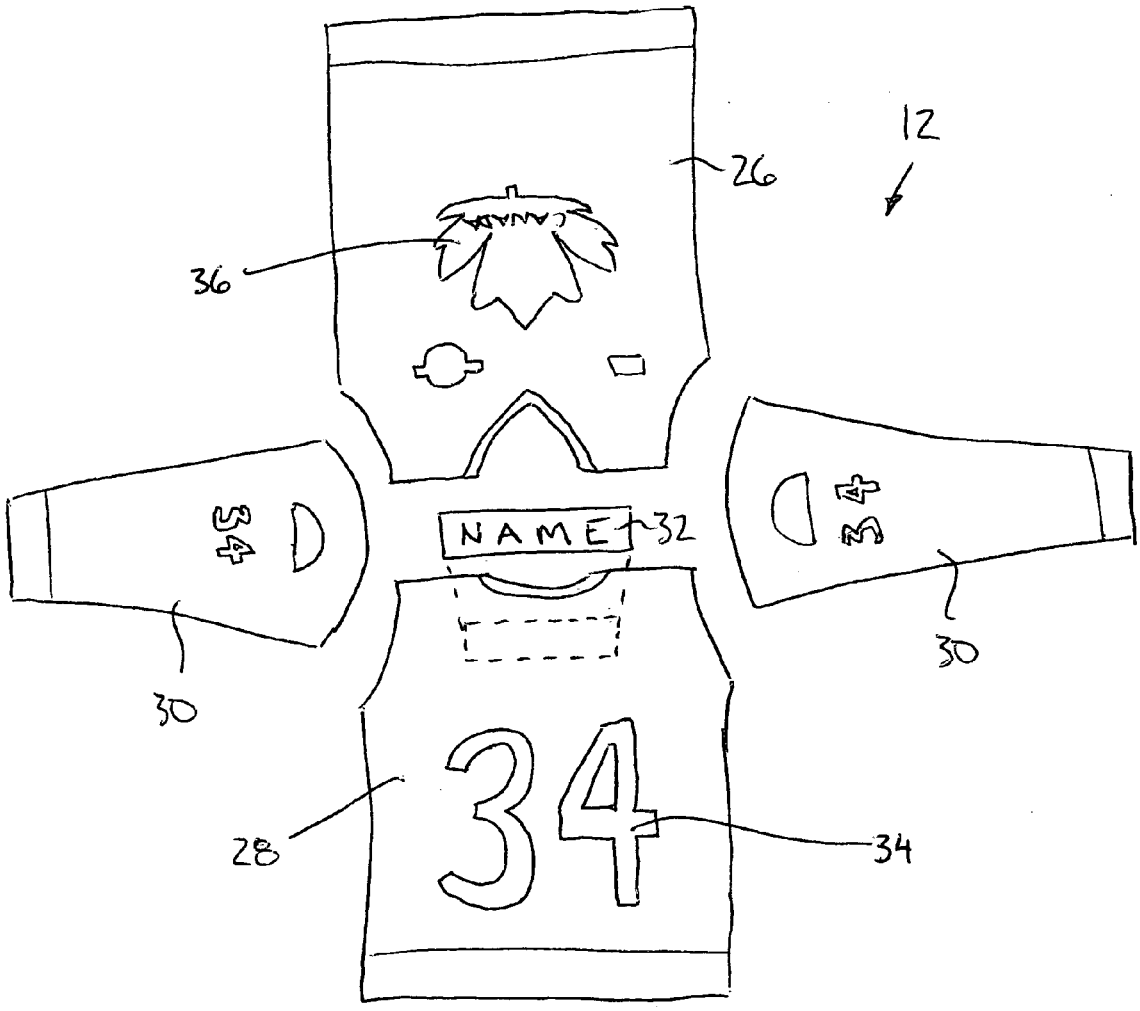
FIG. 5 is an exploded view of the components of the sports jersey.

In order to upholster the chair with the jersey, the jersey is first separated into separate panels comprising the front side 26, the back side 28, the two arms 30 and the name bar 32 as best shown in FIG. 5. Each of the separate components is thus trimmed to fit an appropriate location of the chair. In particular the front side 26 of the jersey is fitted to the inward facing back supporting surface 18 of the chair and the back side 28 of the jersey is trimmed to fit the upward facing seat supporting surface 14 of the chair. The jersey arms 30 are fitted to the chair arms 22. Additional fabric material which is pliable in nature is used to form front and rear leg pieces 38, a rear panel 40 of the back supporting surface and seat trim panels about the bottom side of the seat supporting surface 14.

Figure 6:
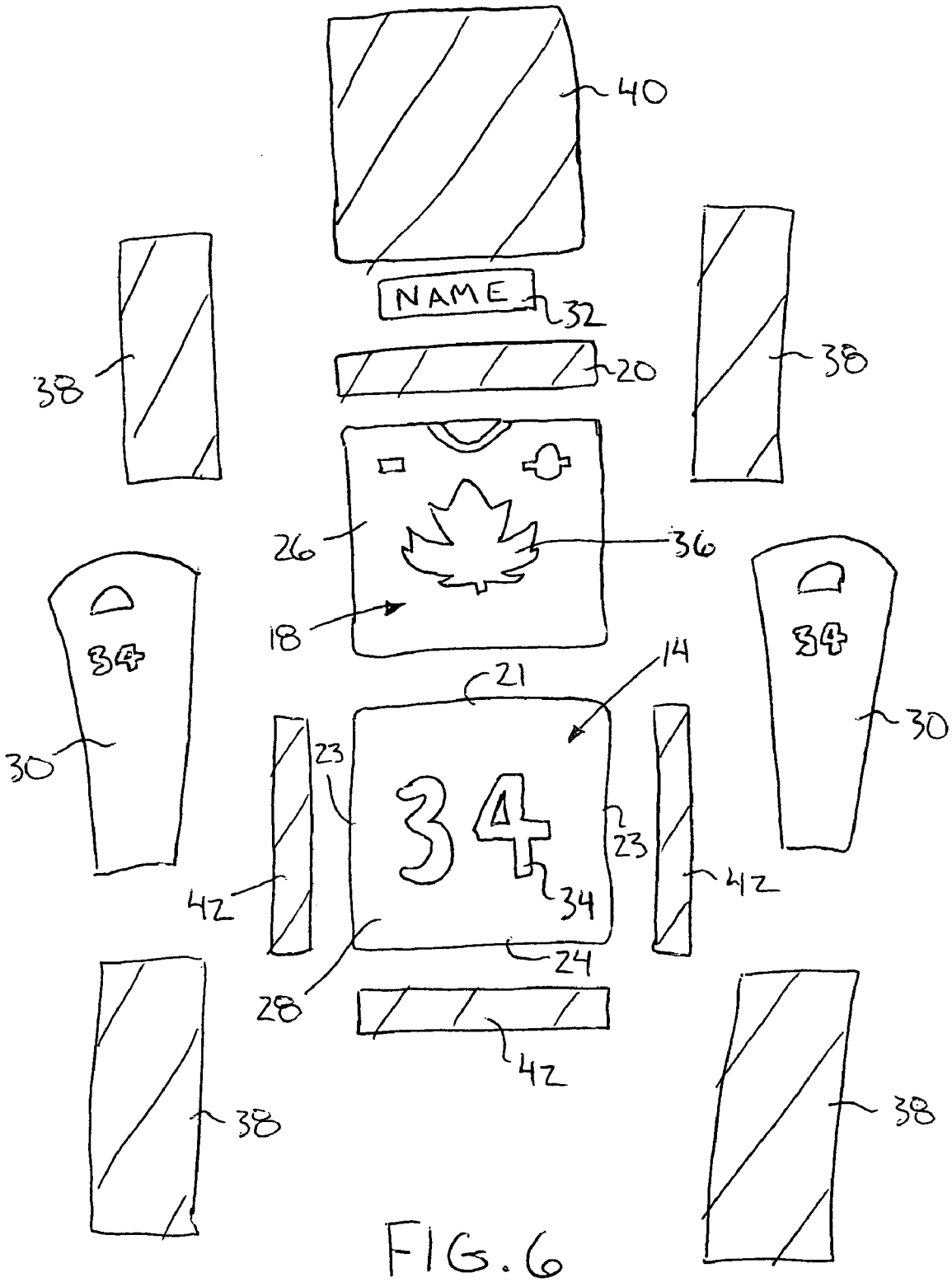
FIG. 6 is an exploded view of the pattern pieces used to upholster the chair.

Using conventional upholstering techniques, the pattern pieces of FIG. 6 are sewn together and assembled about the chair so that the front and back sides of the sports jersey are displayed on the most visible broad surfaces of the seat supporting surface and the back supporting surface of the chair. The team logo 36 is centered with respect to the back supporting surface 18 of the chair while the player number 34 is somewhat centered on the seat supporting surface 14.

The jersey arms are attached to the chair so that the inner ends corresponding to the shoulders of the assembled sports jersey are connected to the back support surface of the chair near the top side thereof so as to provide the similar illusion of shoulders to the chair. The name bar 32 is placed across the top side 20 of the back supporting surface 18 to complete the chair.

The front side 26 of the jersey is positioned so that the neck opening is adjacent the top side of the back supporting surface and the bottom edge as located adjacent the seat supporting surface so that the team logo 36 thereon remains upright in a readily readable manner. Similarly the back side of the jersey is positioned so that the bottom edge of the jersey is located adjacent the front edge 24 of the seat while the neck opening is located adjacent the back support surface 18 at the rear edge 21 of the seat. The additional pattern pieces 38, 40 and 42 are formed of a material which matches colour of the jersey so as to provide the general appearance that all pattern pieces of the upholstered chair are formed from the jersey.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of displaying a sports jersey on a chair, said method comprising:

providing a sports jersey comprising a front side and a back side joined together at seams to form a torso portion of the sports jersey having a neck opening and arm openings therein;

providing a chair having a seat support surface arranged for supporting a person seated thereon in which the seat support surface is arranged to be supported spaced above the ground and a back support surface extending upwardly from the seat support surface;

separating the front side and the back side of the sports jersey into separate panels; and upholstering one of the support surfaces of the chair with either the front side or the back side of the sports jersey.

2. The method according to claim 1 including upholstering the back support surface with the front side of the sports jersey.

3. The method according to claim 1 including upholstering each of the back support surface and the seat support surface with one of the front and back sides of the sports jersey respectively.

4. The method according to claim 3 including upholstering the back support surface with the front side of the sports jersey and upholstering the seat support surface with the back side of the sports jersey.

5. The method according to claim 1 wherein the chair includes chair arms and the sports jersey includes jersey arms joined with the front side and the back side of the jersey, the method including separating the jersey arms from the front side and the back side of the jersey and upholstering the chair arms with the jersey arms.

6. The method according to claim 5 wherein the front side and the back side of the jersey comprise fabric material.

7. The method according to claim 1 including upholstering a top side of the back support surface with a name bar of the sports jersey.

8. The method according to claim 1 wherein the chair includes legs and the method includes upholstering the legs with pliable material matching the sports jersey in color.

9. A method of displaying a sports jersey on a chair, the sports jersey having a front side and a back side, said method comprising:

providing a jersey comprising a front side and a back side joined together at seams to form a torso portion having a neck opening and arm openings therein, and jersey arms comprising tubular sleeves joined with the front side and the back side of the jersey at the arm openings;

providing a chair having a seat support surface arranged for supporting a person seated thereon in which the seat support surface is arranged to be supported spaced above the ground and a back support surface extending upwardly from the seat support surface;

separating the front side, the back side and the jersey arms of the jersey into separate panels;

upholstering the back support surface of the chair with one of the front side and the back side of the sports jersey;

upholstering the seat support surface of the chair with the other one of the front side and the back side of the sports jersey; and upholstering the chair arms of the chair with the jersey arms of the sports jersey.

10. The method according to claim 9 including upholstering the back support surface with the front side of the sports jersey and upholstering the seat support surface with the back side of the sports jersey.

11. The method according to claim 9 wherein the front side, the back side and the jersey arms of the jersey comprise fabric material.

* * * * *